United States Patent [19]

Matsuda et al.

[11] Patent Number: 4,651,501

[45] Date of Patent: Mar. 24, 1987

[54] WRAPPING MACHINE FOR USE IN A PACKAGING SYSTEM

[75] Inventors: Katsumi Matsuda; Kunio Kono, both of Hiroshima, Japan

[73] Assignee: Mitsubishi Jukogyo Kabushiki Kaisha, Tokyo, Japan

[21] Appl. No.: 873,777

[22] Filed: Jun. 11, 1986

[30] Foreign Application Priority Data

Jul. 8, 1985 [JP] Japan ..... 60-148203

[51] Int. Cl.[4] ..... B65B 7/20

[52] U.S. Cl. ..... 53/383; 53/374; 493/130; 493/141; 493/183

[58] Field of Search ..... 53/383, 374, 491, 207, 53/203, 77, 209; 493/141, 142, 183, 131, 130

[56] References Cited

U.S. PATENT DOCUMENTS 3,504,478 4/1970 Dieter ..... 53/209 X
4,460,349 7/1984 Charron ..... 493/142 X
4,480,421 11/1984 Rece ..... 53/383 X
4,519,181 5/1985 Sherman et al. ..... 493/183 X
4,562,687 1/1986 Green, Jr. ..... 53/383

FOREIGN PATENT DOCUMENTS 2142897 1/1985 United Kingdom ..... 493/131

*Primary Examiner*—James F. Coan
*Attorney, Agent, or Firm*—Wenderoth, Lind & Ponack

[57] ABSTRACT

There is disclosed a wrapping machine for use in a packaging system, which comprises a conveyor for transporting a U-shaped case adapted to warp an article and formed in such a way that front and rear flaps of a flat sheet are folded toward the front and rear sides of the article, an inner flap folding mechanism for folding side flaps of the sheet toward both sides of the article while the case is transported, a gluing mechanism for applying glue to the outer surfaces of the inner flaps, and a side flap fold/press mechanism having guide plates actuated selectively by a cam drive mechanism and hydraulic cylinders and adapted to fold and press the side flaps toward the glue bearing surfaces of the inner flaps.

1 Claim, 5 Drawing Figures

WRAPPING MACHINE FOR USE IN A PACKAGING SYSTEM

BACKGROUND OF THE INVENTION

1. Field of the Invention

The present invention relates to a wrapping machine for use in a packaging system, wherein a flat sheet for wrapping an article, is folded to form a U-shaped case and inner flaps of the case are folded and glued and then, side flaps of which are folded and pressed to the inner flaps while the case is transported.

2. Description of the Related Art

A conventional wrapping machine includes a bucket conveyor on which a flat sheet is placed. Arranged on the sheet is an article to be wrapped. Front and rear flaps of the sheet are folded toward the front and rear sides of the article by flap folding guides to thereby form a U-shaped case. This case, with the article placed thereon, is advanced by the bucket conveyor. Inner flaps of the U-shaped case are folded toward the right and left sides of the article by an inner flap folding mechanism, said folding mechanism including flap guides and swing cutters. Arranged on both sides of the bucket conveyor are a side flap folding mechanism including fixed guide bars and guide plates, and a gluing mechanism including four hot-melt applicators. Side flaps of the U-shaped case are folded 45° relative to both sides of the article, and maintained in its state by means of the guide plates. Glue is then applied to predetermined outer surfaces of the inner flaps by the four hot-melt applicators. Thereafter, the side flaps are folded up to 90° by the fixed guide bars. The side flaps are pressed, by a press mechanism, onto the inner flaps to form a case. This case is intended to cover the lower half of the article wrapped therein.

It should be mentioned that when the machine is in its inoperative state, hydraulic cylinders are actuated to raise the guide plates from 45° to 90° so as to press the side flaps onto the inner flaps for joining purposes.

In such a conventional wrapping machine, however, folding operation of the fixed guide bars is not adequately carried out. As a consequence, cases, when completed, may not uniformly be shaped. Moreover, a space is necessary to arrange the fixed guide bars. This arrangement will require longer size of the machine.

SUMMARY OF THE INVENTION

It is, therefore, an object of the invention to provide a wrapping machine for use in a packaging system, which may precisely fold side flaps of a case and adhesively attach the same to inner flaps thereof.

It is another object of the invention to provide a wrapping machine which can easily and economically be maintained.

It is a further object of the invention to provide a wrapping machine which does not require a space for fixed guide bars and thus, is capable of reducing the entire length of the machine.

According to the invention, there is provided a wrapping machine which comprises a conveyor for transporting a U-shaped case adapted to wrap an article and formed in such a way that front and rear flaps of a flat sheet are folded toward the front and rear sides of the article, an inner flap folding mechanism for folding side flaps of the sheet toward both sides of the article while the case is transported, a gluing mechanism for applying glue to the outer surfaces of the inner flaps, and a side flap fold/press mechanism having guide plates actuated selectively by a cam drive mechanism and hydraulic cylinders and adapted to fold and press the side flaps toward the glue bearing surfaces of the inner flaps.

The above and other objects, features, and advantages of the invention will become more clear from a consideration of the following description when taken in conjunction with the accompanying drawings.

DESCRIPTION OF THE PREFERRED EMBODIMENT

Figure 1:
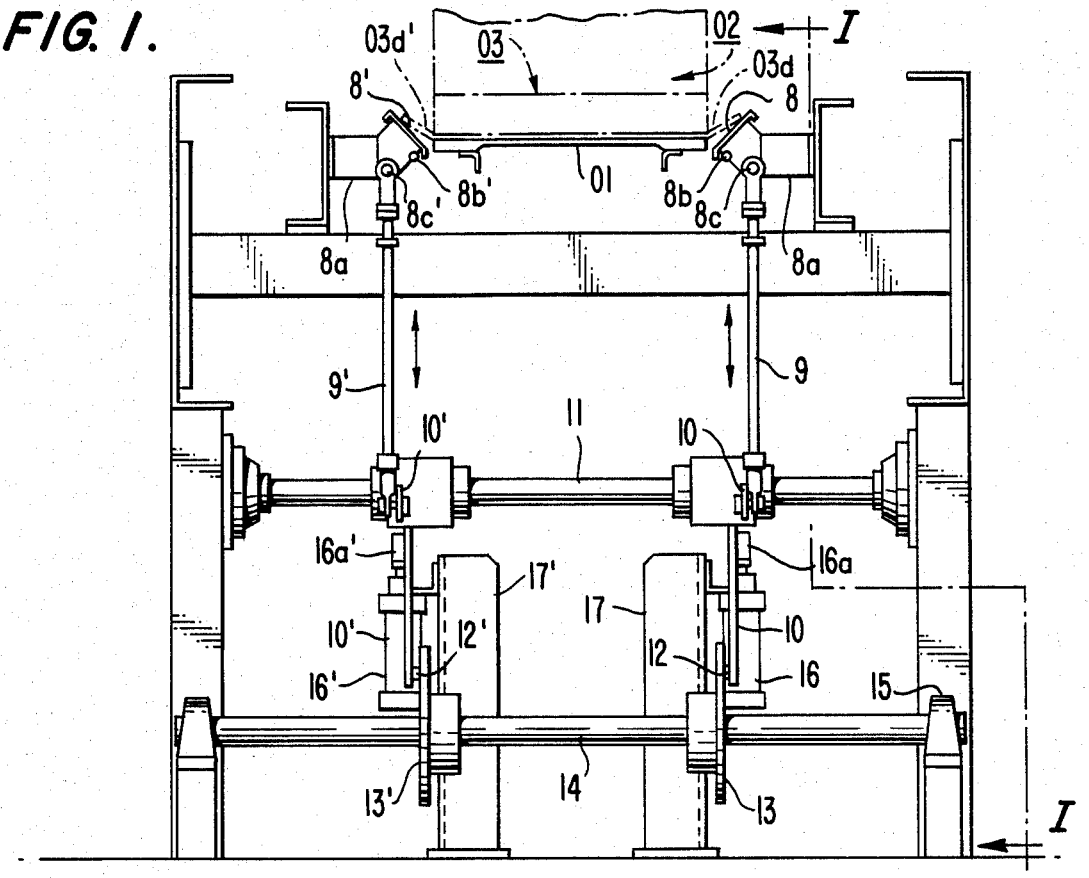
FIG. 1 is a front elevational view of a side flap fold/-press mechanism constructed according to the invention.
Figure 2A:
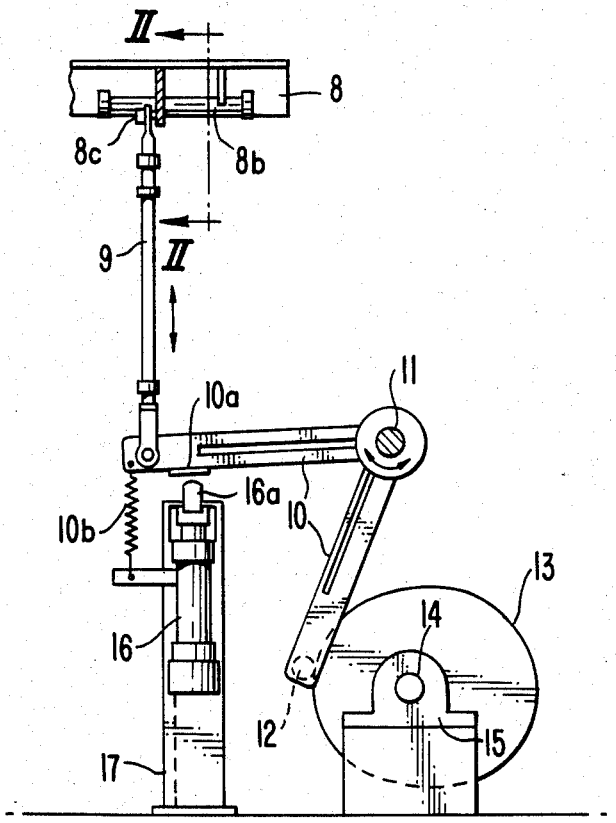
FIG. 2(A) is a view taken on the line I—I of FIG. 1.
Figure 2B:
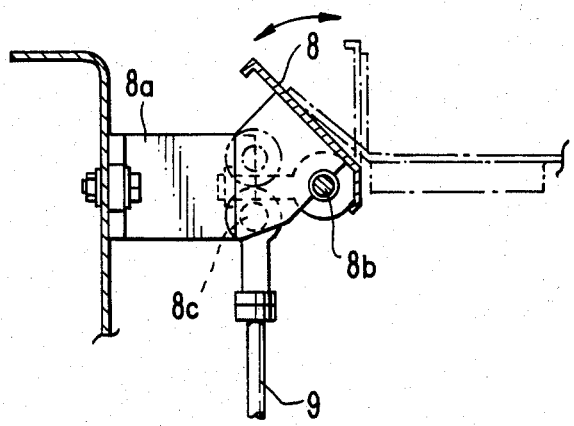
FIG. 2(B) is a view taken on the line II—II of FIG. 2(A)

The present invention is characterized by the provision of a side flap fold/press mechanism as shown in FIG. 1 and FIGS. 2(A) and 2(B).

Figure 3A:
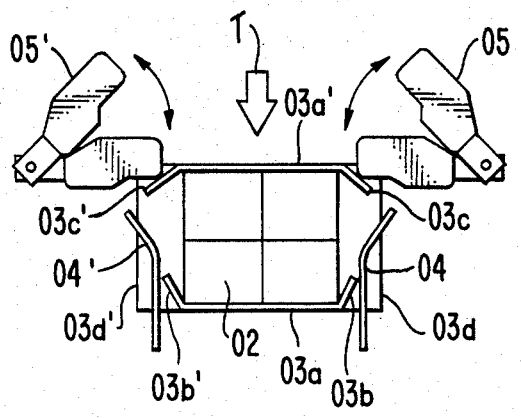
FIG. 3A. (PRIOR ART)
FIG. 3(A) is a top plan view of an inner flap folding mechanism of conventional construction.
Figure 3B:
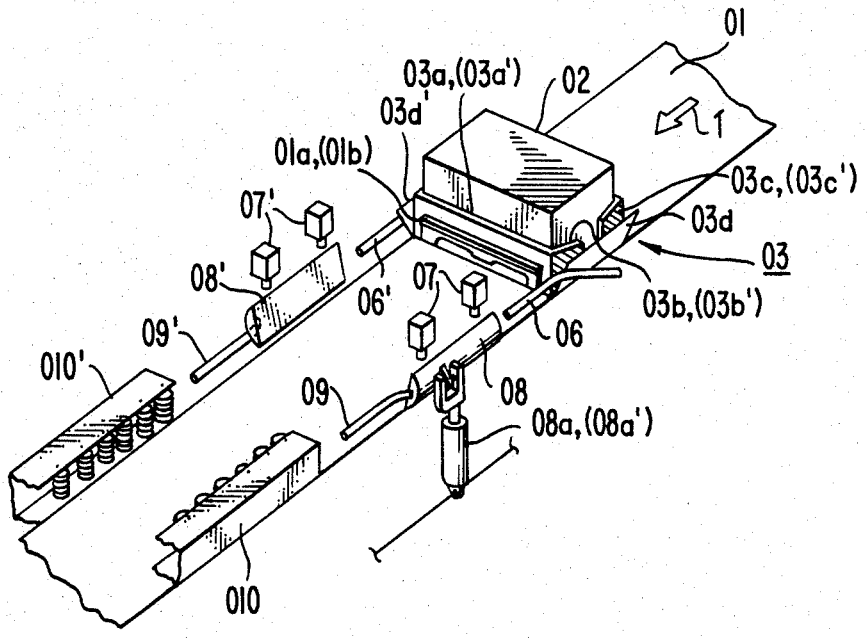
FIG. 3B. (PRIOR ART)
FIG. 3(B) is a perspective view of a conventional wrapping machine.

With now reference to FIGS. 3(A) and 3(B), there is illustrated a wrapping machine for use in a packaging system, including a bucket conveyor (01) on which a flat sheet (03) is placed. Arranged on the sheet (03) is an article to be wrapped. Front and rear flaps **(03*a*) and (03*a*′) of the sheet (03) are folded toward the front and rear sides of the article (02) by flap folding guides (01*a*) and (01*a*′) to form a U-shaped case. This case, together with the article (02), is advanced in the direction of the arrow (λ) by means of the bucket conveyor (01). Inner flaps (03*b*), (03*b*′), (03*c*) and (03*c*′) of the U-shaped case are folded toward the right and left sides of the article (02) by an inner flap folding mechanism (04,05), said folding mechanism including flap guides (04) and (04′), and swing cutters (05) and (05′) as best seen in FIG. 3(A). Arranged on both sides of the bucket conveyor (01) are a side flap folding mechanism (06, 08) including fixed guide bars (06) and (06′) and guide plates (08) and (08′), and a gluing mechanism (07,07′) including four hot-melt applicators (07), (07), (07′) and (07′). The side flap folding mechanism (06,08) is intended to fold side flaps (03*d*) and (03*d*′) of the U-shaped case 45°. The gluing mechanism (07,07′) is intended to apply glue to predetermined outer surfaces of the inner flaps (03*b*), (03*b*′), (03*c*) and (03*c*′)**.

According to the invention, there is provided a side flap fold/press mechanism arranged on both sides of the U-shaped case and immediately after the inner flap folding mechanism (06,08) and the gluing mechanism (07).

With reference to FIG. 1 and FIGS. 2(A) and 2(B) in more detail, the side flap fold/press mechanism generally comprises a pair of guide plates (8) and (8′) provided on both sides of the bucket conveyor (01) and pivotally connected to support arms **(8*a*) via pins (8*b*) and (8*b*′) projecting from the support arms (8*a*). The support arms are, in turn, secured to the machine frame. The pair of guide plates (8) and (8′) have a corresponding pair of brackets to which pins (8*c*) and (8*c*′) are affixed. Connected to the pins (8*c*) and (8*c*′) are expansible turnbuckles (9) and (9′). Pivotted to a shaft (11)** of the machine frame are cam levers (10) and (10'), one ends of which being connected to the lower ends of the turnbuckles (9) and (9') and the other ends of which being provided with cam followers (12) and (12'). The cam levers also have patches (10*a*) and (10*a*') adjacent the turnbuckles (9) and (9'). Cams (13) and (13') are mounted to a cam shaft (14) which is, in turn, supported by a bearing assembly (15), said cams being rotated by a drive source not shown. The side flaps fold/press mechanism also includes hydraulic cylinders positioned vertically and supported by supporting frames (17) and (17'), and having rods front ends (16) and (16') of which being contacted with the patches (10*a*) and (10*a*') when the rods are moved upwards. Springs (10*b*) and (10*b*') are disposed between the hydraulic cylinders (16) and (16') and the cam levers (10) and (10'). The turnbuckles, the cam levers, the cam followers and the cams together constitute cam drive mechanisms (9,10,12,13) and (9',10'12'13'). With this arrangement, the guide plates (8) and (8') are rotated, by the cam drive mechanisms, up to 90° from 45° position to thereby fold the side flaps (3*d*) and (3*d*') toward the glue bearing surfaces on the inner flaps (3*b*), (3*b*'), (3*c*) and (3*c*') for joining purposes. This operation is adjustably effected upon transportation of the respective U-shaped cases. It should be noted that when the machine is not in operation, the hydraulic cylinders (16) and (16') are actuated to move rods (16*a*) and (16*a*') upwards, thereby raising the patches (10*a*) and (10*a*') of the cam levers (10) and (10'). Thus, the guide plates (8) and (8') are positioned upright via the turnbuckles (9) and (9').

In operation, the flat sheet (03) placed on the bucket conveyor (01) are folded at its front and rear flaps (03*a*) and (03*a*') toward the front and rear sides of the article (02) to thereby form a U-shaped case. While the case is being transported, the inner flaps (03*b*), (03*b*'), (03*c*) and (03*c*') of the case are folded toward the both sides of the article (02) by the inner flap folding mechanism (04,05). The side flaps (03*d*), (03*d*') of the case are folded 45° by the fixed guide bars (06) and (06') and the guide plates (8) and (8'). Then, glue is applied by the gluing mechanism (07,07') to predetermined areas on the inner flaps (03*b*), (03*b*'), (03*c*) and (03*c*') of the case. Thereafter, the side flaps (3*d*) and (3*d*') now folded 45° by the guide plates (08) and (08'), are further folded precisely up to 90° by the guide plates (8) and (8') of the side flap fold/-press mechanism, thereby joining them together.

The guide plates (8) and (8') of the side flap fold/press mechanism are rotated by the cam drive mechanism, as stated above. In this arrangement, folding operation of the side flaps (03*d*) and (03*d*') by the guide plates (8) and (8') may finely be adjusted by changing the phase of the cams or the effective length of the turnbuckles. Thus, the timing of folding operation may precisely and continuously be controlled for each case.

Additionally, when the machine is not in operation, the hydraulic cylinders (16) and (16') are adapted to be actuated to move the rods (16*a*) and (16*a*') upwards for rotation of the guide plates (8) and (8'). Hereby, the side flaps (03*d*) and (03*d*') are folded and pressed to join the glue bearing areas of the inner flaps. This prevents the glue applied to the inner flaps from drying out, thus eliminating poor wrapping.

It will be appreciated that the side flap fold/press mechanism constructed according to the invention corresponds to the fixed guide bars (09) and (09') and the press mechanism (010) and (010'). Therefore, no extra space is necessary to provide the fixed guide bars. This enables to reduce the entire length of the machine.

It is to be understood that the invention is not limited to the embodiment described above with reference to the accompanying drawings, but changes and modifications may be made without departing from the spirit and scope of the invention. Accordingly, the scope of the patent protection being sought is defined by the following claims.

What is claimed is:

1. A wrapping machine for use in a packaging system, comprising a conveyor for transporting a U-shaped case adapted to wrap an article and formed in such a way that front and rear flaps of a flat sheet are folded toward front and rear sides of said article, an inner flap folding mechanism for folding side flaps of said sheet toward both sides of said article while said case is transported, a gluing mechanism for applying glue to the outer surfaces of said inner flaps, and a side flap fold/press mechanism having guide plates actuated selectively by a cam drive mechanism and hydraulic cylinders and adapted to fold and press said side flaps toward said glue bearing surfaces of said inner flaps.

* * * * *